US012262802B2

(12) United States Patent
Greenwaldt

(10) Patent No.: US 12,262,802 B2
(45) Date of Patent: Apr. 1, 2025

(54) TRADING CARD VAULT

(71) Applicant: Troy Greenwaldt, Dilworth, MN (US)

(72) Inventor: Troy Greenwaldt, Dilworth, MN (US)

( * ) Notice: Subject to any disclaimer, the term of this patent is extended or adjusted under 35 U.S.C. 154(b) by 0 days.

(21) Appl. No.: 17/727,978

(22) Filed: Apr. 25, 2022

(65) Prior Publication Data

US 2023/0337798 A1 Oct. 26, 2023

(51) Int. Cl.

| | |
|---|---|
| ***A45C 11/18*** | (2006.01) |
| ***A45C 13/02*** | (2006.01) |
| ***A45C 13/10*** | (2006.01) |

(52) U.S. Cl.

CPC ..... *A45C 11/18* (2013.01); *A45C 13/02* (2013.01); *A45C 13/1069* (2013.01); *A45C 2013/026* (2013.01)

(58) Field of Classification Search

CPC ..... A45C 11/18; A45C 13/1069; A45C 2013/026

USPC ..... 206/454

See application file for complete search history.

(56) References Cited

U.S. PATENT DOCUMENTS

| | | | | |
|---|---|---|---|---|
| 8,011,510 | B1 * | 9/2011 | Smith, II | B65D 75/22 206/509 |
| 2009/0134575 | A1 * | 5/2009 | Dickinson | A63F 1/062 273/149 R |
| 2011/0031139 | A1 * | 2/2011 | Macor | B01L 3/54 206/232 |
| 2013/0146487 | A1 * | 6/2013 | Macor | B65D 85/58 206/232 |
| 2015/0225156 | A1 * | 8/2015 | Bruns | A47F 7/0042 206/487 |
| 2022/0258947 | A1 * | 8/2022 | Ramirez | A45C 11/18 |
| 2022/0415211 | A1 * | 12/2022 | Taylor | G09F 1/12 |
| 2023/0048773 | A1 * | 2/2023 | Burko | G09F 1/10 |
| 2023/0073593 | A1 * | 3/2023 | Blom | A45C 11/18 |
| 2023/0145620 | A1 * | 5/2023 | Cummings | A45C 11/18 206/223 |
| 2023/0172373 | A1 * | 6/2023 | Wiginton | A47G 1/06 206/775 |

* cited by examiner

*Primary Examiner* — Jacob K Ackun

(74) *Attorney, Agent, or Firm* — Fargo Patent & Business Law; Thomas Kading; Joshua Krank

(57) ABSTRACT

The present application discloses a card vault that can be used for the storage of trading cards. The design of the vault allows for a penny sleeve to be stored within a toploader and the toploader to be placed within the vault. Collecting trading cards is an activity in which people store cards of various shapes and sizes. These trading cards may be sports cards or other types of collectible cards.

10 Claims, 8 Drawing Sheets

TRADING CARD VAULT

CROSS-REFERENCE TO RELATED APPLICATION(S)

This application claims the priority to U.S. Provisional Patent Application No. 63/180,139, filed Apr. 27, 2021, the contents of which are hereby incorporated by reference in its entirety.

FIELD OF TECHNOLOGY

This disclosure generally relates to technology for storing and preserving trading cards.

BACKGROUND

Collecting trading cards is an activity in which people store cards of various shapes and sizes. These trading cards may be sports cards or other types of collectible cards. Often these cards can be valuable and proper storage is important to maintain the value. It is important to properly protect a trading card when it is being stored. Some of the important storage issues include ensuring that the corners and edges of a trading card are not dented or bent. Further ensuring light damage does not occur is an important factor. Storage devices with ultraviolet light protection are commonly required for trading card storage.

Traditionally trading cards have generally been stored in a variety of devices. Three commonly used devices include a penny sleeve, a toploader, and a one touch. A penny sleeve is a flexible thin plastic sleeve in which a trading card is inserted. A toploader is a plastic container that is slightly thicker than a penny sleeve, allowing a penny sleeve to be placed inside. The toploader is flexible. A one touch trading card holder is a device that allows for a card to be placed directly within. Current commercially available one touch devices do not allow for a toploader to fit within a one touch. The one touch is a rigid storage device. Commonly, more valuable cards are stored in one touch storage devices. Many in the trading card industry prefer to use penny sleeves as it is understood that penny sleeves help better protect trading cards when bending and denting may be less of a concern.

Trading cards come in various thicknesses, including but not limited to 35, 55, 75, and 100 point. Trading cards commonly come in dimensions including 6.35 cm×8.89 cm (2.5 in ×3.5 in) and other sizes. The trading cards may be often stored in single, double, and triple storage devices.

SUMMARY

The present application discloses a card vault that can be used for the storage of trading cards. The design of the vault allows for a penny sleeve to be stored within a toploader and the toploader to be placed within the vault. For the sake of this application, the card vault or case is consider the "vault". The vault allows collectors of trading cards to store trading cards while taking advantage of both the penny sleeve and toploader benefits while also providing the superior protection offered by the vault. A long-felt need in the trading card industry has desired such innovation.

An exemplary vault comprises a base in which the card within a toploader with a penny sleeve sits, a cover, and a method to connect the base and the cover. In some embodiments, a magnet is placed in the cover, and a magnet is placed in the base such that the two magnets may be pulled together in a way to pull the cover and the base together. One or more notches can be used on the end of the vault opposite to the two magnets such that the cover and the base may be secured together on one end with magnets and the other end with the notches. The base and cover may be sized such that a toploader may be placed within the vault without modification to the vault or damage to the trading card.

BRIEF DESCRIPTION OF THE DRAWINGS

These and other features and advantages of the present invention will become more readily appreciated as the same becomes better understood by reference to the following detailed description when considered in connection with accompanying drawings, wherein.

DETAILED DESCRIPTION OF THE ILLUSTRATED EMBODIMENTS

General

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

Figures Detail

Putting a card in a penny sleeve and then a toploader offers scratch protection for the card. Just putting a card in a one touch can cause some surface scuffing and/or scratches. A very slight scuff mark on the surface could mean thousands of dollars of damage on a graded card. However, toploaders currently commercially available may be still somewhat flimsy, and the card can still be damaged or creased in transport and mail. Whereas the vault device offers superior protection for the card used for mailing, storage, and display. Many higher-end collectors refuse to use the existing commercially available toploaders for such purposes.

Figure 1:
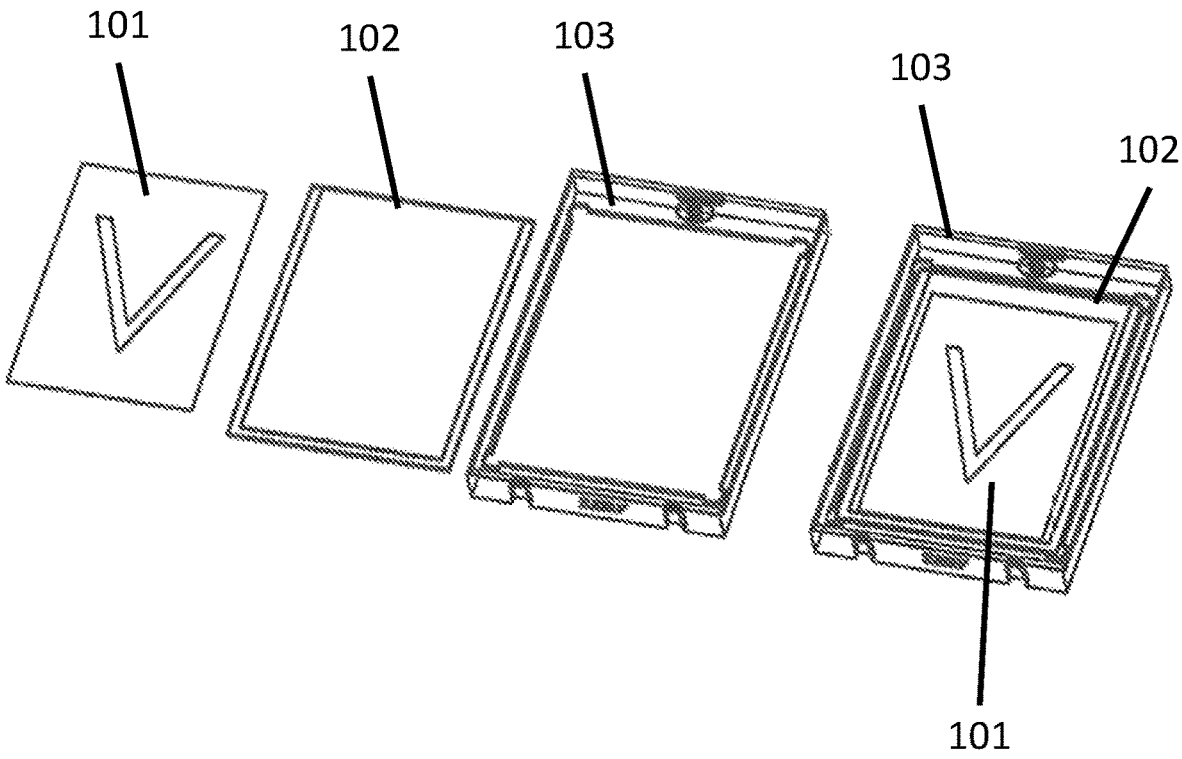
FIG. 1 shows a toploader, a penny sleeve, and a vault.

In FIG. 1, a penny sleeve 101, a toploader 102, and a vault 103 are shown in an exploded form and a combined form. A card may be placed in the penny sleeve 101, the penny sleeve 101 with the card may be placed in the toploader 102, and the toploader 102 with its contents may be placed in the vault 103. To place a card in a penny sleeve 101, a card is typically inserted from one side and slid into the penny sleeve 101. The penny sleeve 101 may also be referred to as a card sleeve. A penny sleeve 101 is commonly an acid-free, archival product made of crystal-clear polypropylene. The penny sleeve 101 typically covers both the front and back of a card. A toploader 102 is typically a plastic card holder used for protecting a card from damage from tearing, bending, or edge/corner impacts. A toploader 102 has an opening at the top such that a card or a penny sleeve 101 may slide into the toploader 102. The toploader 102 may contain a penny sleeve 101 when the penny sleeve 101 is slid into the toploader 102.

A card for the sake of this application refers to any variation of trading card which may come in a variety of thickness including but not limited to 35, 55, 75, and 100 point. Trading cards commonly come in dimensions including 6.35 cm×8.89 cm (2.5 in ×3.5 in) and other sizes. For example, a trading card may have dimensions greater than 6.00 cm×8.00 cm (2.4 in ×3.2 in). A card may include any type of trading card, including but not limited to sports cards or game cards.

Figure 2:
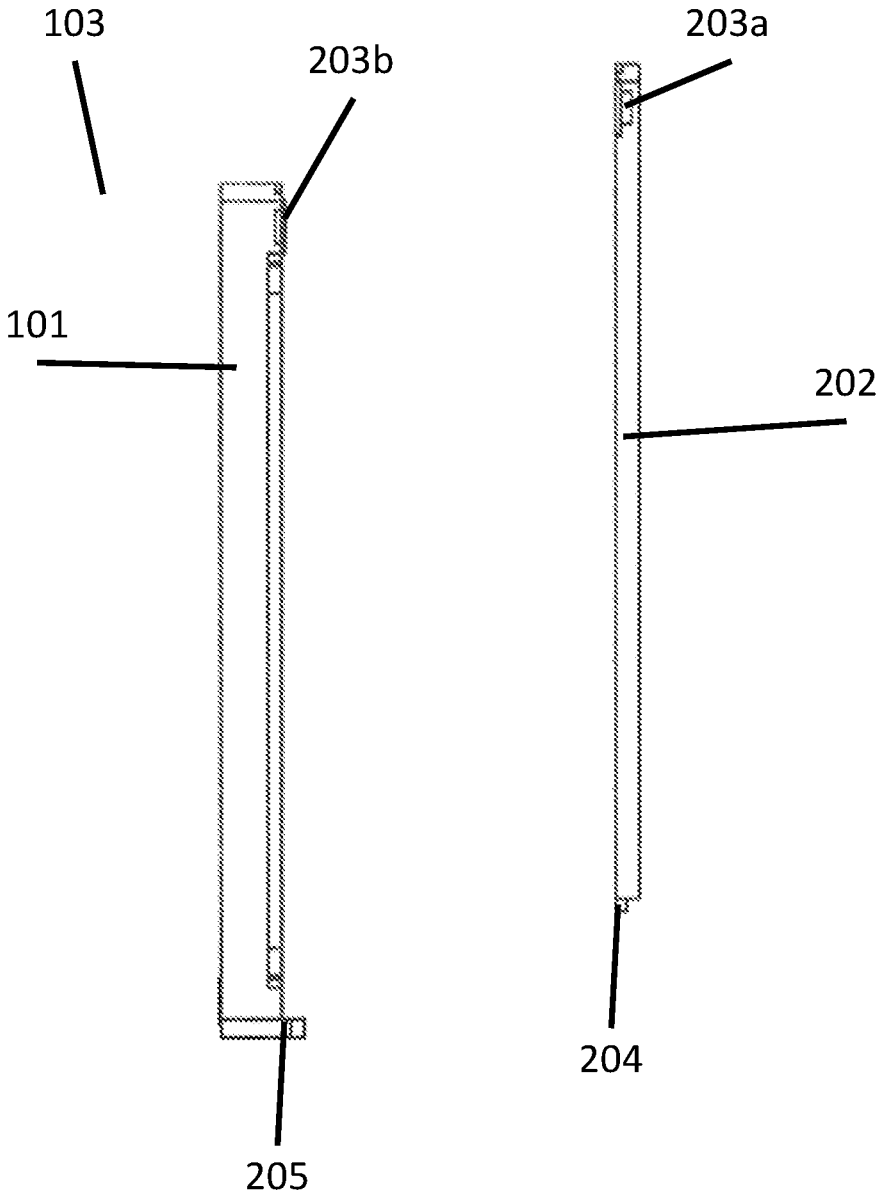
FIG. 2 shows an exploded vault device from a side profile.

FIG. 2 shows an exemplary vault 103 in an exploded view from a side profile. The embodiment in FIG. 2 is a single card vault. The vault 103 is comprised of a base 201, a cover 202, and a set of magnets 203. The set of magnets 203 includes the base magnet 203*b* and the cover magnet 203*a* (collectively a set of magnets 203). The base magnet 203*b* may comprise of one or more magnets. The base magnet 203*b* may be attached to the base 201. The cover magnet 203*a* may comprise one or more magnets. The cover magnet 203*a* may be attached to the cover 202. The cover magnet 203*a* and the base magnet 203*b*, or a replacement material that is magnetic, is position respectively in the base 201 and cover 202 such that the base magnet 203*b* and cover magnet 203*a* may be magnetically pulled together so to cause the base 201 and cover 202 to be secured together.

In some embodiments, either the cover magnet 203*a* or the base magnet 203*b* may be replaced by any material which is magnetic. On the end of the cover 202 opposite to the end with the cover magnet 203*a*, at least one notch 204 extends from the cover 202. At least one corresponding pocket 205 is located on the base 201 such that the notch 204 may be inserted into the pocket 205 and the set of magnets 203 may be secured together by magnetic force. The action of the notch 204, pocket 205, and set of magnets 203 cause the cover 202 and the base 201 to be held securely together. The notch 204 and pocket 205 may secure one side of the base 201 and cover 202 together. One side is understood to reference one edge if looking at the vault 103 from a top profile. For example, one side could be the edge of the base 201 and cover 202 opposite of a magnet. The cover 202 and the base 201 is sized such that a card along with a penny sleeve 101 and a toploader 102 may fit within the first card slot 301*a* while being securely held together. When the cover 202 and the base 201 is secured together the toploader 102 and the toploader's contents are enclosed in the base 201 by the cover 202. The cover 202 encloses the toploader 102, the penny sleeve 101, and a card within the first card slot 301*a*. The cover has a surface 402 that is transparent or clear through which a card in a card slot 301 may be viewed. Transparent is understood to mean allowing light to pass through so that objects behind can be distinctly seen. Transparent does not need to be perfectly clear.

Figure 3:
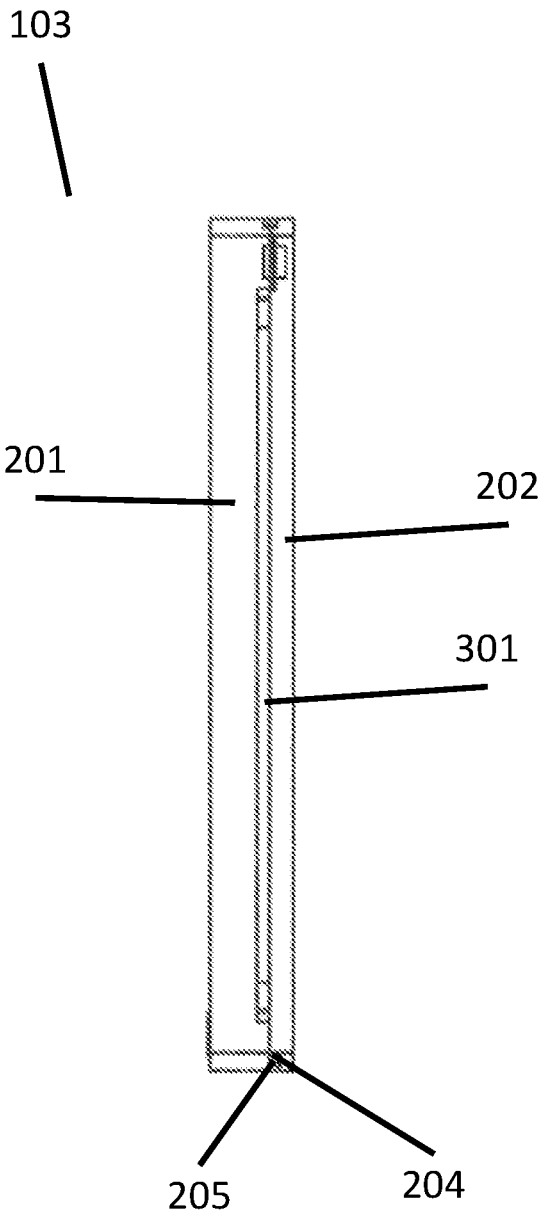
FIG. 3 shows a vault device from a side profile.

FIG. 3 shows an exemplary vault 103 from a side profile when the cover 202 and the base 201 are secured together. In FIG. 3 the notch 204 is shown inserted into the pocket 205. The base magnet 203*b* and the cover magnet 203*a* may be secured together. The first card slot 301*a* is of shape and size to allow for a toploader 102 with a penny sleeve 101 that contains a card. The first card slot 301*a* is of shape and size to allow for a toploader 102 to fit in the first card slot 301*a*. Alternatively, the first card slot 301*a* could be shaped and sized such that the first card slot 301*a* contains a penny sleeve 101, which contains a card. In each embodiment, it is important that the first card slot 301*a* is sized slightly larger than the items contained such that the items do not freely move around.

Figure 4:
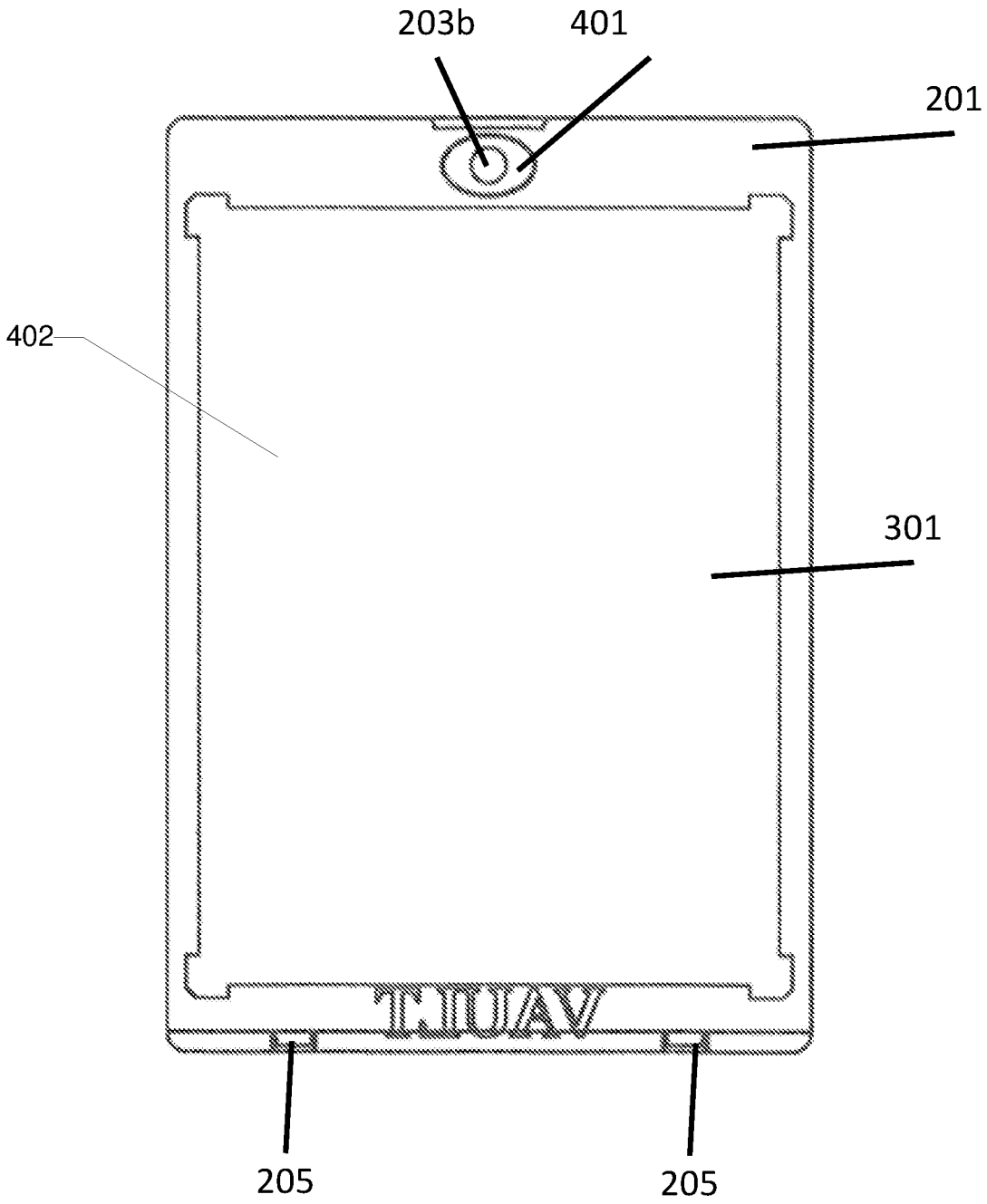
FIG. 4 shows a base from a single vault device from a front profile.

FIG. 4 shows an exemplary base 201 from a single vault device from a front profile. The first card slot 301*a* comprises the majority of the area of the front profile of the base 201. At the bottom of the base 201 in this embodiment two pockets (individually a pocket 205) are shown. At the top of the base 201 a base magnet 203*b* is located and is recessed into magnet groove 401.

Figure 5:
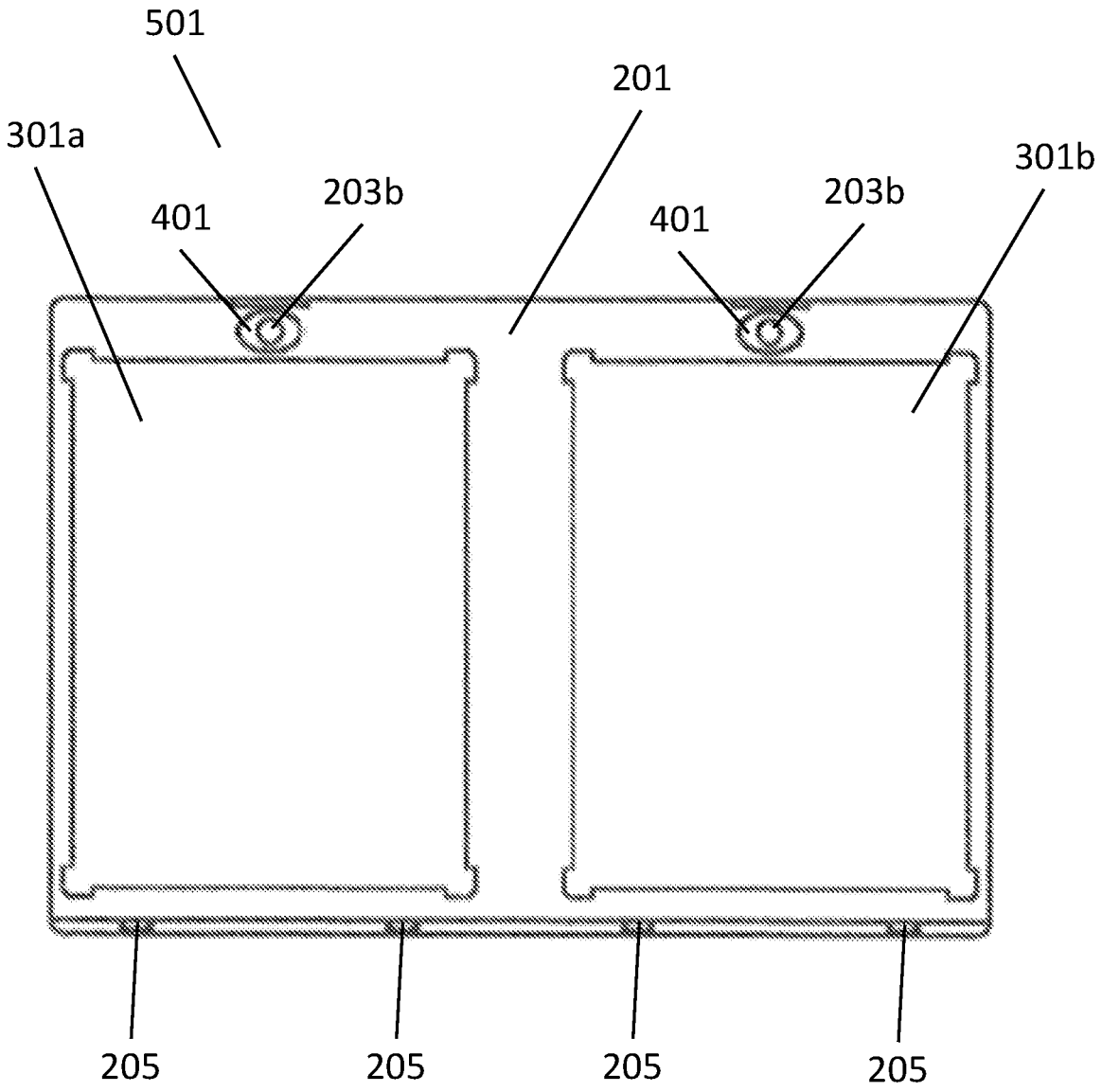
FIG. 5 shows a double vault device from a front profile.

FIG. 5 shows an exemplary double vault device 501 base 201 from a front profile. In this example, there may be two card slots (individually a card slot 301). There may be a first card slot 301*a* and a second card slot 301*b*. There may be four pockets (individually a pocket 205) in this example. There may be two magnet grooves (individually a magnet groove 401) in this example. There may be two base magnets (individually a base magnet 203*b*) in this example. A vault 103 may be configured with any variation of magnets. For example, the base 201 and the cover 202 may contain multiple magnets. Further, the base 201 and the cover 202 may have an unequal number of magnets comparatively or on or the other might have no magnets while the other has a metal that is magnetic. The base 201 and cover 202 may alternatively be used to secure the vault 103 together. For example, a fastener such as a screw or glue may be used. An individual card may be placed in either card slot 301. Two cards may be placed in the double vault device 501. The double vault device 501 also employs the use of a cover 202, which is matched in size with the base 201.

Figure 6:
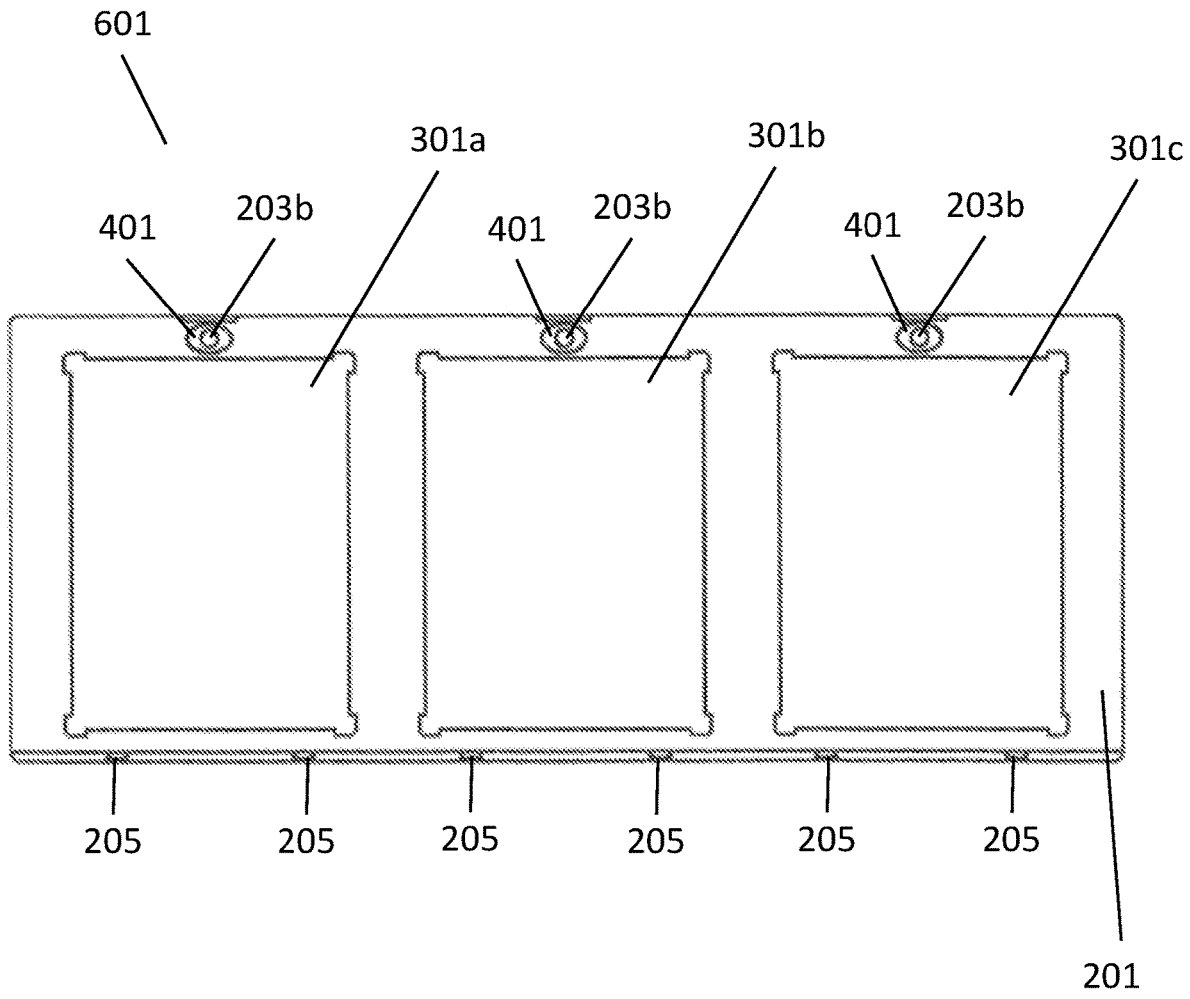
FIG. 6 shows a triple vault device from a front profile.

FIG. 6 shows an exemplary triple vault device 601 base 201 from a front profile. In this example, there may be three card slots (individually a card slot 301). There may be a first card slot 301*a*, a second card slot 301*b*, and a third card slot 301*c*. There may be six pockets (individually a pocket 205) in this example. There may be three magnet grooves (individually a magnet groove 401) in this example. There may be three base magnets (individually a base magnet 203*b*) in this example. An individual card may be placed in any card slot 301. Three cards may be placed in the triple vault device 601. The triple vault device 601 also employs the use of a cover 202, which is matched in size with the base 201.

Figure 7:
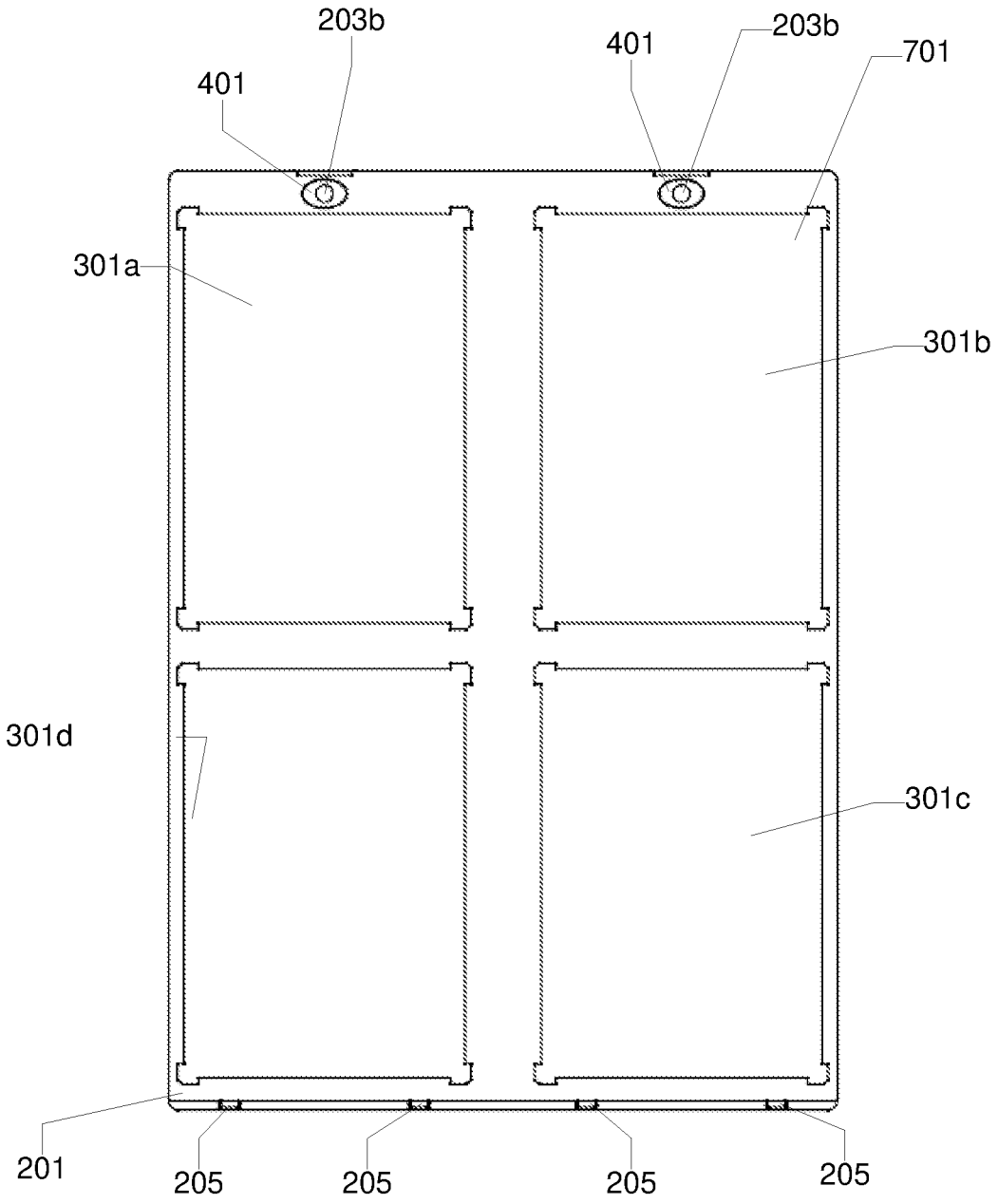
FIG. 7 shows an quad vault device from a front profile.

FIG. 7 shows an exemplary quad vault device 701 from a front profile. In this example, there may be four card slots (individually a card slot 301). There may be a first card slot 301*a*, a second card slot 301*b*, a third card slot 301*c*, and a fourth card slot 301*d*. There may be four pockets (individually a pocket 205) in this example. There may be two magnet grooves (individually a magnet groove 401) in this example. There may be two base magnets (individually a base magnet 203*b*) in this example. An individual card may be placed in any card slot 301. Four cards may be placed in the quad vault device 701. The quad vault device 701 also employs the use of a cover 202, which is matched in size with the base 201.

Figure 8:
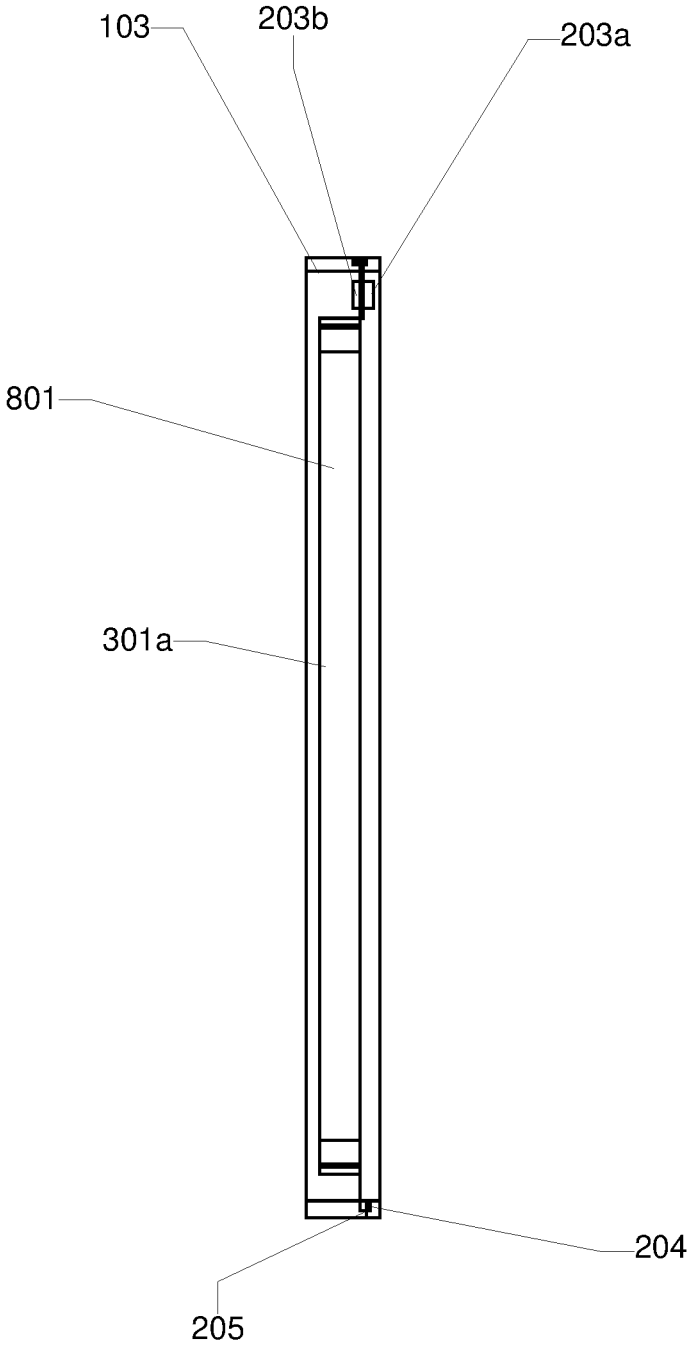
FIG. 8 shows a vault device with a graded card package from a side profile.

FIG. 8 shows a vault 103 device with a graded card package 801 from a side profile. The cover 202 and the base 201 are shown secured together. In FIG. 8 the notch 204 is shown inserted into the pocket 205. The base magnet 203*b* and the cover magnet 203*a* may be secured together. The first card slot 301*a* is of shape and size to allow for a graded card package 801 that contains a card. The first card slot 301*a* is of shape and size to allow for a graded card package 801 to fit in the first card slot 301*a*. In each variation of the vault 103, it is important that the first card slot 301*a* is sized only slightly larger than the items contained such that the items do not freely move around.

Other embodiments of the invention may include but are not limited to vault devices sized to fit a 12.7 cm×17.8 cm (5 in ×7 in) picture or a 20.3 cm×25.4 cm (8 in ×10 in) autographed photo. Other sizes may be used in other embodiments. For example, an embodiment may be sized to fit a comic book.

An alternative embodiment of the vault device is one wherein the penny sleeve 101 and the toploader 102 may be replaced by a graded card package. When the toploader 102 is replaced by a grade card package, the toploader 102 comprising the vault 103 is consider graded card package. A graded card package is one where a card is cast within a hard plastic case, generally by an organization that grades trading cards. If a grading card package is cracked or scratched, it takes substantial effort to repair or replace.

The vault 103 may be manufactured from any material which can be manufactured in such a way that the vault 103 is clear or transparent such to see the card which may be stored in the a card slot 301. Generally, the manufacturing method will comprise of injection molding but may include other understood methods.

Explanation of Exemplary Language

While various inventive aspects, concepts and features of the general inventive concepts are described and illustrated herein in the context of various exemplary embodiments, these various aspects, concepts and features may be used in many alternative embodiments, either individually or in various combinations and sub-combinations thereof.

Unless expressly excluded herein all such combinations and sub-combinations are intended to be within the scope of the general inventive concepts. Still further, while various alternative embodiments as to the various aspects, concepts and features of the inventions (such as alternative materials, structures, configurations, methods, devices and components, alternatives as to form, fit and function, and so on) may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the general inventive concepts even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

The invention claimed is:

1. A card vault, comprising:

a card;

a penny sleeve that contains the card;

a toploader that contains the penny sleeve;

a base, the base comprising a first card slot, the first card slot of shape and size to allow for the toploader to fit in the first card slot, wherein the base comprises a pocket;

a cover, the cover comprising a surface, the cover secures to the base, wherein the cover comprises a notch, the notch inserted into the pocket to secure one side of the base and cover together to enclose the toploader, the penny sleeve, and the card; and a base magnet, the base magnet attached to the base.

2. The card vault of claim 1, further comprising a cover magnet, the cover magnet attached to the cover, the base magnet and the cover magnet positioned respectively in the cover and the base so the base magnet and the cover magnet are magnetically pulled together causing the base and the cover to be secured together on an end opposite to the notch and the pocket.

3. The card vault of claim 1, further comprising a material that is magnetic, the material attached to the cover, the base magnet and the material positioned respectively in the cover and the base so the base magnet and the material are magnetically pulled together causing the base and the cover to be secured together on an end opposite to the notch and the pocket.

4. The card vault of claim 2, wherein the surface is transparent.

5. The card vault of claim 4, wherein the card is a sports card.

6. The card vault of claim 4, wherein the card is a game card.

7. The card vault of claim 4, wherein the card has dimensions greater than 6.00 cm×8.00 cm.

8. The card vault of claim 4, wherein the card has a thickness of 55 point.

9. The card vault of claim 4, wherein the toploader is a graded card package.

10. A card vault for a card, comprising:

a base comprising a first card slot to receive a card, the base comprises a pocket;

a cover that comprises a notch, the notch inserted into the pocket to secure one side of the base and cover together to enclose the card;

a base magnet attached to the base; and a cover magnet attached to the cover, the base magnet and the cover magnet positioned respectively in the cover and the base so the base magnet and the cover magnet are magnetically pulled together causing the base and the cover to be secured together on an end opposite to the notch and the pocket.

* * * * *